United States Patent [19]

Morell

[11] Patent Number: 4,982,964

[45] Date of Patent: Jan. 8, 1991

[54] GOLF BALL

[75] Inventor: Joseph Morell, Annecy, France

[73] Assignee: Salomon S.A., Annecy, France

[21] Appl. No.: 442,214

[22] Filed: Nov. 28, 1989

[30] Foreign Application Priority Data

Nov. 29, 1988 [FR] France ..... 88 15569

[51] Int. Cl.[5] ..... A63B 37/12; A63B 37/14

[52] U.S. Cl. ..... 273/232; 40/327

[58] Field of Search ..... 273/232; 40/327

[56] References Cited

U.S. PATENT DOCUMENTS

| | | | |
|---|---|---|---|
| 4,762,326 | 8/1988 | Gobush | 273/232 |
| 4,772,026 | 9/1988 | Gobush | 273/232 |
| 4,844,472 | 7/1989 | Ihara | 273/232 |

FOREIGN PATENT DOCUMENTS

| | | | |
|---|---|---|---|
| 735557 | 8/1932 | France | 273/232 |
| 107170 | 7/1982 | Japan | 273/232 |
| 2176409 | 12/1986 | United Kingdom | 273/232 |

*Primary Examiner*—George J. Marlo

[57] ABSTRACT

The present invention relates to a golf ball.

The peripheral surface (2) of the golf ball has dimples defining, by their intersection with this peripheral surface (2) intersection circles (55,57,59,61,62,63) which in their majority (55,57,59,61,62) are distributed essentially inside 24 identical elemental surfaces (50) in spherical isosceles right-angle triangle form defined by 6 equatorial circles (44 to 49) of the sphere defining the general shape of the peripheral surface (2) of the ball (3) each of the equatorial circles (44 to 49) being centered on an axis passing through the respective midpoints of two diametrically opposed edges of a cube inscribed in this sphere; a determined one (48) of these equatorial circles cutting none of the intersection circles subdividing each of the other equatorial circles (44,45,46,47,49) into two circular arcs (**44*a* and 44*b*, 45*a* and 45*b*, 46*a* and 46*b*, 47*a* and 47*b*, 49*a* and 49*b*) which mutually cut in threes at points (7,11) of the peripheral surface (2), at least one (63) of the intersection circles being arranged around a respective one of the these points (7,11**).

The orientation of the ball with respect to the strike can thus be rendered substantially independent, while a strike on the said determined equatorial circle (48) is avoided.

10 Claims, 1 Drawing Sheet

GOLF BALL

The present invention relates to a golf ball, of the type having a peripheral surface having the general shape of a sphere and a plurality of dimples arranged in the said peripheral surface and defining by their intersections with this intersection circles distributed on the said peripheral surface in accordance with a repetitive motif determined by subdivision of the said peripheral surface along 6 equatorial circles of which each is centered on an axis passing through the respective midpoints of 2 diametrically opposed edges of a cube inscribed in the sphere, in a manner to define 24 identical elemental surfaces in spherical, isosceles right-angle triangle form, inside which the said intersection circles are essentially distributed, at least one determined equatorial circle, amongst the said equatorial circles, cutting none of the said intersection circles and subdividing each of the others of the said equatorial circles into two equatorial circular arcs, of which each corresponds to one of two hemispheres defined by the said determined equatorial circle, the said equatorial circular arcs cutting mutually each other in pairs or threes at determined intersection points on each hemisphere.

A ball of this type is described in U.S. Pat. No. 4,772,026 which, with reference to its FIGS. 2 to 7 and 9 to 14, proposes a certain number of distribution motifs for intersection circles inside elemental surfaces in spherical isosceles right-angle triangle form.

It should be noted that, in a general manner, these known motifs allow the existence locally, on the spherical peripheral surface of the golf ball, of relatively significant areas devoid of dimples, so that the player is obliged to orient his ball carefully before striking it, if he wishes to benefit from a significant probability of hitting the peripheral surface of the ball in zones of this surface having a substantially identical geometry for each strike, in order to ensure the reproducibility of strikes.

The object of the present invention is to remedy this inconvenience by proposing a mode of distribution of intersection dimples on the peripheral surface of the golf ball permitting reduction to the greatest extent possible of the areas of this peripheral surface existing between the intersection circles.

For this, the present invention proposes a golf ball of the type indicated in the preamble, further characterized in that at least one intersection circle is arranged about a respective one of the said intersection points of 3 equatorial circular arcs.

Preferably, an intersection circle is also arranged respectively about each of the points of intersection of 3 equatorial circular arcs, this allied to a judicious choice of the motif for distribution of intersection circles inside each elemental surface, permits the obtaining of a covering as complete as possible of the peripheral surface of the golf ball by intersection circles, that is to say by dimples; thus, the player concerned always to strike the ball in zones having a substantially identical geometry need be concerned only, before each strike, to check that the orientation of the ball is not such that the strike hits the peripheral surface of the latter in the region of the said determined equatorial circle, the only eventuality causing the need for reorientation of the ball.

Naturally, only certain points of intersection of 3 equatorial circular arcs can have a dimple, that is to say a circle of intersection of such a dimple with the peripheral surface of the golf ball, one of them or several of them being able to retain the shape of an area intermediary between intersection circles arranged inside respective elemental surfaces as the mentioned US patent proposes, or having the form of a flat, to receive for example a manufacturer's mark; certainly, such a choice meets the desired object of the present invention in that it can oblige the player to reorient his ball more often than when each point of intersection of 3 equatorial circular arcs has an intersection circle, but this inconvenience remains limited to the extent that the number of points of intersection of 3 equatorial circles thus devoid of intersection circles itself remains limited.

It should be noted that putting the present invention into effect does not involve difficulty in the manufacture of the ball, because one of the mentioned equatorial circles, that is to say the said determined equatorial circle, cuts none of the circles of intersection of a dimple with the peripheral surface of the golf ball. This determined equatorial circle can in effect correspond to a joint plane when the ball is made by assembly of two identical halves or when at least one surface layer of this, comprising the dimples, is made by moulding in a single piece in a mould itself formed of two assembled identical halves, which correspond to known methods of manufacture, whose simplicity and economy of operation are also known.

To compensate for the absence of any intersection circle on this determined equatorial circle, that is to say to reduce any disadvantage from this absence of areas of the spherical peripheral surface existing at this region between the intersection circles, it can be provided that the equatorial circular arcs of one of the hemispheres are angularly displaced, with respect to the respectively corresponding equatorial circular arcs of the other of the hemispheres, by the same amount about the axis of the said determined equatorial circle; naturally, this notion of angular displacement is intended with reference to the geometrical construction of the subdivision of the peripheral surface of the ball into elemental surfaces.

Preferably, those intersection circles which are not situated at the intersection of 3 equatorial circular arcs are distributed in an identical motif in the elemental surfaces, the said motif being preferably chosen in a manner to ensure a distribution as homogeneous as possible, of areas of the peripheral surface of the golf ball existing between the intersection circles.

For this, there can be chosen a motif based on the motif illustrated in FIG. 9 of the mentioned U.S. Patent, which motif has several mutually neighboring rows of which a first is adjacent to the hypotenuse of a spherical right-angle triangle and of which each mutually connects the two edges of the right angle of the spherical right-angle triangle and has a respective determined number of regularly distributed intersection circles of the same diameter, this determined number being for each row less by one unit than the determined number of intersection circles in the respectively neighboring row nearer to the hypotenuse and each intersection circle of each row being adjacent to two intersection circles of the said respectively neighboring row nearer to the hypotenuse. Nevertheless, instead of giving the same diameter to all the intersection circles thus arranged in the same elemental surface, as taught with reference to FIG. 9 of the mentioned U.S. Patent, it is preferred in accordance with the present invention that the respective intersection circles of the said rows have a diameter which reduces as the row to which they belong is further from the hypotenuse of the spherical right-angle triangle, an arrangement which is preferably allied to an arrangement as described in the mentioned U.S. patent, in accordance with which each row has end intersection circles respectively adjacent to the one and the other of the sides of the right angle of the spherical right angle triangle, the said end intersection triangles corresponding to the same side of the right angle of the spherical right angle triangle further being mutually adjacent.

Thus, according to a preferred embodiment of the invention, the said first row comprises five mutually adjacent intersection circles, which are adjacent to the hypotenuse of the spherical right-angle triangle and of which two end intersection circles are also respectively adjacent to one and the other of the sides of the right angle of the spherical right-angle triangle, and the said rows further comprise:

a second row of 4 mutually disjoint intersection circles, of which each is adjacent to two intersection circles of the first row and of which two end intersection circles are also adjacent respectively to the one and the other of the sides of the right angle of the right-angle spherical triangle, a third row of 3 mutually disjoint intersection circles, of which each is adjacent to two intersection circles of the second row and of which two end intersection circles are also respectively adjacent to the one and the other of the sides of the right angle of the spherical right-angle triangle, a fourth row of 2 mutually disjoint intersection circles, of which each is adjacent to two intersection circles of the third row and respectively to the one and the other of the sides of the spherical right-angle triangle, a single intersection circle adjacent to the two intersection circles of the fourth row and to the two sides of the right angle.

It can be easily imagined from this that the areas of the peripheral surface of the golf ball existing between two intersection circles, inside each elemental surface as well as from one elemental surface to another, can be reduced to a minimum; also to this end, there is given to the intersection circle situated around a respective one of the said points of intersection of 3 equatorial circular arcs a diameter such that it is adjacent to six intersection circles of which each is situated in a respective one of the elemental surfaces and constitutes in this elemental surface one of the said end intersection circles of the said respective first row.

Other characteristics and advantages of a ball according to the present invention will appear from the description below of a non-limitative embodiment, as well as from the accompanying drawings which form an integral part of this description.

Figure 1:
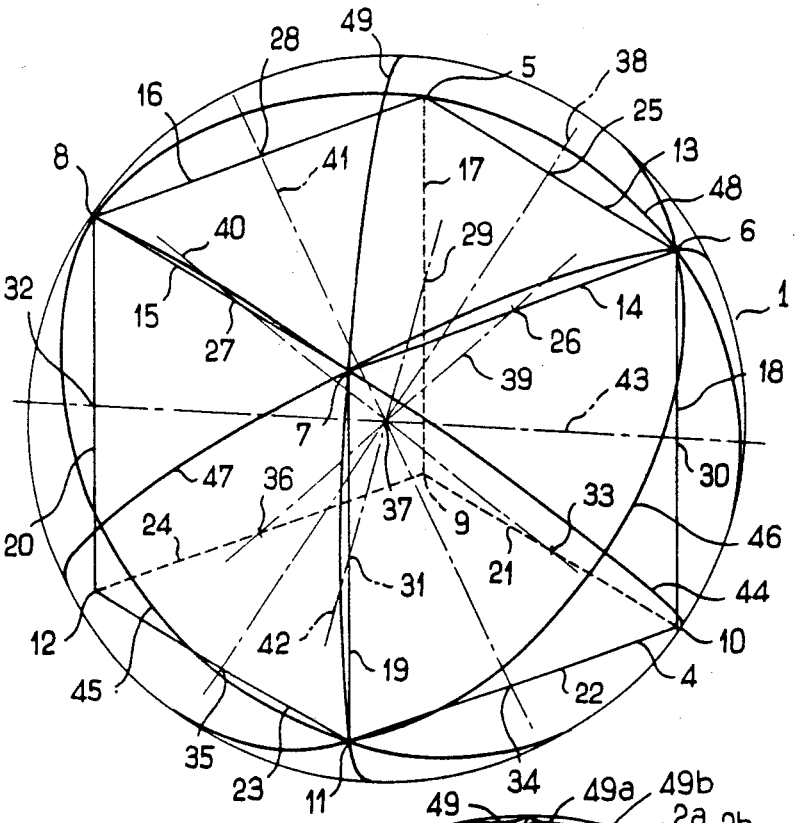
FIG. 1 illustrates the construction of 6 equatorial circles on a sphere from a cube inscribed in this latter.

Referring in the first place to FIG. 1, in it there is designated by 1 the sphere having the general shape of the peripheral surface 2 of a golf ball 3, illustrated in FIG. 2, and by 4 a cube inscribed in this sphere on which it has 8 apices 5 to 12 connected in pairs by 12 edges 13 to 24 of which each has a midpoint 25 to 36; the cube 4 and the sphere 1 having a common center 37 which will serve as a reference when reference is made below to the notation of diametrically opposed positions.

Figure 2:
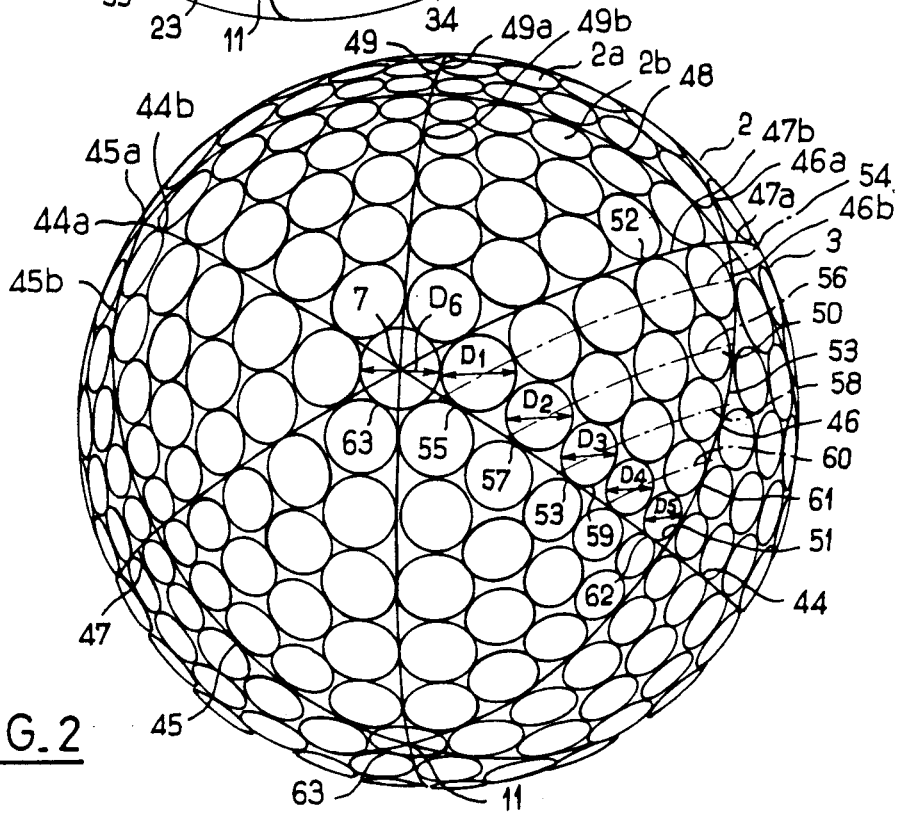
FIG. 2 shows a golf ball of which the dimples, or more precisely the intersection circles of these dimples with the peripheral surface of the ball, are distributed according to the present invention.

For geometrical reasons, the edges 13 to 24 of the cube 4 fall into 6 groups of two mutually parallel, diametrically opposed edges, that is to say the edges 13 and 23, 14 and 24, 15 and 21, 16 and 22, 17 and 19, 18 and 20 of which the respective midpoints also occupy diametrically opposed positions; for putting the present invention into effect, via the respective midpoints of two diametrically opposed edges, an axis is determined, that is to say the axis 38 passing through the midpoints 25 and 25, the axis 39 passing through the midpoints 26 and 36, the axis 40 passing through the midpoints 27 and 33, the axis 41 passing through the midpoints 28 and 34, the axis 42 passing through the midpoints 29 and 31, and the axis 43 passing through the midpoints 30 and 32; about each of the 6 axes thus determined, in a plane (not referenced) perpendicularly cutting the axis at the center 37 of the cube 4 and of the sphere 1, there is set out on this sphere 1 an equatorial circle passing through 4 apices of the cube, that is to say the circle 44 with the axis 38, passing through the apices 7,8,9,10, the circle 45 with the axis 39, passing through the apices 5,10,11,8, the circle 46 with the axis 40, passing through the apices 5,6,11,12, the circle 47 with the axis 41, passing through the apices 6,7,12,9, the circle 48 with the axis 42 passing through the apices 6,12,8 and the circle 49 with the axis 43, passing through the apices 5,9,11,7; the six circles 44 to 49 are also shown on the peripheral surface of the ball 3 in FIG. 2, but it should be noted that it is not necessary for these circles to be materially reproduced on this surface 2.

It should be noted that, for geometrical reasons, each of the 6 equatorial circles 44 to 49 defines by its plane (not referenced) a plane of symmetry for the others of these equatorial circles.

As FIG. 2 shows, these 6 equatorial circles define 24 identical elemental surfaces 50 in a spherical isosceles right-angle triangle form, which are mutually symmetric with respect to the 6 equatorial circles 44 to 49, and of which there the right angle by 51 is designated, the hypotenuse by 52, and the two sides of the right angle by 53; it should be noted that the hypotenuse 52 and the two sides 53 of the right angle 51 of an elemental surface 50 are common to a respectively neighboring elemental surface.

In a manner known in itself, in this spherical peripheral surface 2 of the ball 3 there are arranged dimples which have for example the form of part spherical depressions and define circles by their intersection with this peripheral surface 2.

In their majority, the intersection circles thus defined are distributed according to determined motifs inside elemental surfaces 50, without overlapping any of the equatorial circles in the illustrated example although such overlapping is admissible to a certain extent; preferably nevertheless, in the interest of production of the present invention, one at least of these equatorial circles, that is to say the circle 48, cuts none of the circles of intersection of the dimples with the peripheral surface 2 of the ball 3, to correspond to a joint plane between two halves of the ball if this is made in two halves, or between two halves of a mould intended for the production of the ball, or at least a surface layer of this having the dimples, in a single piece by moulding; preferably, and without departing from the scope of the present invention in adopting a different arrangement, the motif for distribution of the dimples, that is to say the circles of intersection of these latter with the peripheral surface of the ball, is identical from one elemental surface 50 to another; more precisely, the embodiment illustrated in FIG. 2 reproduces this preferred arrangement, in a manner which will now be described in more detail.

In each elemental surface 50, the circles of intersection of the dimples with the spherical peripheral surface 2 of the ball 3 are distributed in the following manner:

a first row 54 of 5 mutually identical intersection circles 55, that is to say of the same diameter $D_1$ chosen so that these 5 circles are adjacent in pairs and adjacent to the hypotenuse 52 of the elemental surface 50, and so that each of the end circles 55 of this row 54 are further adjacent to a respective one of the sides 53 of the right angle 51;

a second row 56 having 4 identical circles 57, that is to say of the same diameter $D_2$ less than the diameter $D_1$ and chosen, in a manner easily determinable by a man skilled in the art, such that the circles 57 are mutually disjoint but are adjacent in respective pairs to the circles 55 of the first row 54 situated between the row 56 and the hypotenuse 52 of the elemental surface, and that each of the end circles 57 of the row 56 are further adjacent to a respective one of the edges 53 of the right angle 51;

a third row 58 having 3 circles 59 of the same diameter $D_3$ less than the diameter $D_2$ and chosen, in a manner easily determined by a man skilled in the art, so that the circles 59 are mutually disjoint but are adjacent in respective pairs to the circles 57 of the second row 56 situated between the row 58 and the hypotenuse 52 of the elemental surface 50, and that each of the end circles 59 of the row 56 are also adjacent to a respective one of the two sides 53 of the right angle 51;

a fourth row 60 of 2 circles 61 of the same diameter $D_4$ less than the diameter $D_3$ of the circles 59 of the third row 58, which diameter $D_4$ is chosen so that the two circles of the row 60 are mutually disjoint but are adjacent to respective pairs of the circles 59 of the third row 58 nearer to the hypotenuse 52 and that each of the circles 61 are adjacent to a respective one of the edges 53 of the right angle 51;

a single intersection circle 62 of diameter $D_5$ less than that of the circle 61 and chosen so that this circle 62 is adjacent at once to the two circles 61 of the fourth row 60 and to the 2 sides 53 of the right angle 51.

The diameters $D_1$, $D_2$, $D_3$, $D_4$, $D_5$ can easily be determined from the previously described positioning of the circles 55,57,59,61,62, by a man skilled in the art.

In a general manner, in the preceding description and the description below, there is intended by the term "adjacent" with respect to circles of intersection of a dimple with the peripheral surface 2 of the ball 3, either in pairs or with respect to an edge delimiting the elemental surface which essentially contains them, a tangential relation or a mutual spacing such that it is small with respect to the diameter of the circles concerned, and for example at most equal to a quarter of this diameter, this figure being indicated by way of non-limitative example.

Further, according to the present invention, dimples made from circles 63 of intersection with the peripheral surface 2 of the ball 3 are arranged respectively about certain of the mutual intersections of the equatorial circles 44,45,46,47,49, the intersections of these latter with the equatorial circle 48 remaining on the contrary devoid of any dimples.

More precisely, if there is designated respectively by **2*a* and 2*b* two hemispheres, which are defined, on the peripheral surface 2 of the ball 3, by the equatorial circle 48, this circle 48 subdivides each of the other equatorial circles 44,45,46,47, 49 into two circular arcs, in practice of semi-circles, respectively 44*a* and 44*b*, 45*a* and 45*b*, 46*a* and 46*b*, 47*a* and 47*b*, 49*a* and 49*b*, of which each is situated on a respective one of the said hemispheres 2*a* and 2*b*; on each of these hemispheres, the respectively corresponding equatorial circular arcs mutually cut on the one hand in pairs, at non-referenced points respectively corresponding to the apex of the right angle 51 of certain elemental surfaces 52 and on the other hand in threes at points which correspond to those of the apices 6 to 12 of the cube 4 inscribed in the sphere 1 which are not situated on the equatorial circle 48, that is to say the apices 5 and 9, not visible in FIG. 2, as regards the hemisphere 2*a* and the apices 7 and 11, visible in FIG. 2, as regards the hemisphere 2*b*; in a non-visible manner, at the apex 5 the circular arcs 45*a*, 46*a*, and 49 cut and at the summit 9 the circular arcs 44*a*, 47*a* and 49 cut; in a visible manner, at the apex 7 the circular arcs 44*b*, 47*b* and 49*b* cut, whilst at the apex 11 the circular arcs 45*b*, 46*b* and 49** cut.

Preferably a circle 63 of intersection of a dimple with the peripheral surface 2 is arranged respectively about each point of intersection of three of the mentioned circular arcs, that is to say about each of the apices 5,7,9,11 of the inscribed cube 4, as is illustrated in FIG. 2 about each of the apices 7,11 situated in the hemisphere **2*b*, it being understood that a man skilled in the art can easily deduce the arrangement of such circles about the apices 5 and 9 situated in the hemisphere 2*a*; preferably, each of the intersection circles 63 has a diameter $D_6$ such that it is adjacent to six intersection circles 55, of which each constitutes one of the end intersection circles of a row 54 adjacent to the hypotenuse 52 of a respective elemental surface 50; the diameter $D_6$ can advantageously be of the same order of size as the diameter $D_1$ when the previously described arrangement of the circles 55,57,59,61,62** is adopted, it being understood that this arrangement as well as the choice of the diameters which follows constitute only non-limitative examples.

In a general manner, the embodiment of the invention which has been described constitutes only a non-limitative example, with respect to which many variants will be provided without departing from the scope of the present invention; in particular, one only or more of the intersection circles 63, four being provided in the previously described, preferred embodiment respectively situated at each of the apices 5,7,9,11 of the cube 4 inscribed in the sphere 1 can be omitted and replaced for example by a respective flat for marking the ball by the manufacturer, which flat will be easily visible and consequently easy to avoid during striking. Further, in a non-shown manner, it can be permitted that the equatorial circular arcs **44*a*, 45*a*, 46*a*, 47*a*, 49*a* of the hemisphere 2*a* are angularly displaced by the same amount and in the same direction about the axis 42 of the equatorial circle 48, with respect to the equatorial circular arcs 44*b*, 45*b*, 46*b*, 47*b*, 49*b* of the hemisphere 2*b*, which involves no major inconvenience and, on the contrary, can compensate for the the absence of any intersection circle on the equatorial circle 48, as indicated above, in subdividing each of the areas of the peripheral surface existing between the intersection circles in the region of this equatorial circle 48, particularly in the region of the intersections of the equatorial circles 44, 45, 46, 47 with this, that is to say about the apices 6, 10, 12, 8 of the inscribed cube 4** in the case of the illustrated example.

I claim:

1. A golf ball comprising a peripheral surface having the general shape of a sphere and a plurality of dimples arranged in the said peripheral surface, said dimples defining intersection circles where they intersect with said peripheral surface, said intersection circles being distributed on said peripheral surface in accordance with a repetitive motif determined by subdivision of said peripheral surface along 6 equatorial circles of which each is centered on an axis passing through respective midpoints of two diametrically opposed edges of a cube inscribed in said sphere, in a manner to define 24 elemental surfaces in the form of a spherical isosceles right-angle triangle, inside which said intersection circles are essentially distributed, at least a determined one of said equatorial circles cutting none of said intersection circles and subdividing each of the others of said equatorial circles into two equatorial circular arcs, of which each corresponds to one of two hemispheres defined by said determined equatorial circle, said equatorial circular arcs mutually cutting in pairs or threes at determined points of intersection on each said hemisphere, wherein at least one intersection circle is arranged about a respective one of said points of intersection of three of said equatorial circular arcs.

2. A golf ball according to claim 1, wherein a said intersection circle is arranged respectively about each of said points of intersection of three of said equatorial circular arcs.

3. A golf ball according to claim 1, said intersection circles are distributed in accordance with an identical motif in said elemental surfaces.

4. A golf ball according to claim 1, wherein said motif has a plurality of mutually neighboring rows of which a first is adjacent to a hypotenuse of said spherical right-angle triangle and of which each mutually connects two edges of said right angle of said spherical right-angle triangle and has a respective determined number of regularly distributed ones of said intersection circles of a same diameter, this determined number being for each row one unit less than the determined number of said intersection circles in a respectively neighboring one of said rows nearer to said hypotenuse and each said intersection circle of each said row being adjacent in pairs of said intersection circles of said respectively neighboring row nearer said hypotenuse.

5. A golf ball according to claim 4, wherein said respective intersection circles of said rows have a diameter reducing as said row to which they belong is further from said hypotenuse of said spherical right-angle triangle.

6. A golf ball according to claim 5 in combination, wherein the first one of said rows has 5 mutually adjacent ones of said intersection circles adjacent to said hypotenuse of said spherical right-angle triangle and of which two end ones of said intersection circles are also respectively adjacent to one and the other of said edges of said right angle of said spherical right-angle triangle, and said rows further comprise:

a second one of said rows of 4 mutually disjoint ones of said intersection circles, of which each is adjacent to two said intersection circles of the first said row and of which two end ones of said intersection circles are also respectively adjacent to the one and the other of said sides of said right angle of said spherical right-angle triangle, a third one of said rows of 3 mutually disjoint ones of said intersection circles, of which each is adjacent to two of said intersection circles of said second row and of which two end ones of said intersection circles are further adjacent respectively to the one and the other of said side of said right angle of said right-angle triangle, a fourth row of two mutually disjoint ones of said intersection circles of which each is adjacent to two of said intersection circles of said third row and respectively to the one and the other of said sides of said right angle of said spherical right-angle triangle, a single one of said intersection circles adjacent to said two intersection circles of said fourth row and to said two sides of said right angle.

7. A golf ball according to claim 4, wherein each said row has two end ones of said intersection circles respectively adjacent to one and the other of said sides of said right angle of said spherical right-angle triangle, said end intersection circles corresponding to the same said side of said right angle of said spherical right-angle triangle being in addition mutually adjacent.

8. A golf ball according to claim 7, wherein one said intersection circle situated about a said point of intersection of three of said equatorial circles is adjacent to six of said intersection circles of which each is situated in a respective one of said elemental surfaces and constitutes in this elemental surface one of said end intersection circles of said respective first row.

9. A gold ball according to claim 7, wherein the first one of said rows has 5 mutually adjacent ones of said intersection circles adjacent to said hypotenuse of said spherical right-angle triangle and of which two end ones of said intersection circles are also respectively adjacent to one and the other of said edges of said right angle of said spherical right-angle triangle, and said rows further comprise:

a second one of said rows of 4 mutually disjoint ones of said intersection circles, of which each is adjacent to two said intersection circles of the first said row and of which two end ones of said intersection circles are also respectively adjacent to the one and the other of said sides of said right angle of said spherical right-angle triangle, a third one of said rows of 3 mutually disjoint ones of said intersection circles, of which each is adjacent to two of said intersection circles of said second row and of which two end ones of said intersection circles are further adjacent respectively to the one and the other of said side of said right angle of said right-angle triangle, a fourth row of two mutually disjoint ones of said intersection circles of which each is adjacent to two of said intersection circles of said third row and respectively to the one and the other of said sides of said right angle of said spherical right-angle triangle, a single one of said intersection circles adjacent to said two intersection circles of said fourth row and to said two sides of said right angle.

10. A golf ball according to claim 1, wherein said equatorial circular arcs of one of said hemispheres are angularly displaced, with respect to the respectively corresponding ones of said equatorial circular arcs of the other of said hemispheres, by the same amount about an axis of said determined equatorial circular arc.

* * * * *